United States Patent [19]

Hendrych

[11] 4,426,259

[45] Jan. 17, 1984

[54] COKE OVEN DOOR SEAL

[75] Inventor: George Hendrych, Bethel Park, Pa.

[73] Assignee: Koppers Company, Inc., Pittsburgh, Pa.

[21] Appl. No.: 375,380

[22] Filed: May 6, 1982

[51] Int. Cl.[3] ..... C10B 25/06; C10B 25/16

[52] U.S. Cl. ..... 202/248; 202/269

[58] Field of Search ..... 202/248, 269; 110/173 R; 49/485

[56] References Cited

U.S. PATENT DOCUMENTS

| | | | |
|---|---|---|---|
| 2,025,967 | 12/1935 | Wilputte | 202/248 |
| 2,579,917 | 12/1951 | Fourmanoit | 202/248 |
| 2,606,865 | 8/1952 | Forsans | 202/269 |
| 2,744,858 | 5/1956 | Homan | 202/248 |
| 3,172,825 | 3/1965 | Maloney | 202/248 |
| 3,952,454 | 4/1976 | Sudo | 202/248 |
| 3,984,310 | 10/1976 | Calderon | 202/248 |
| 4,016,045 | 4/1977 | Van Ackeren | 202/248 |
| 4,026,769 | 5/1977 | Steimann | 202/248 |
| 4,032,409 | 6/1977 | Knappstein et al. | 202/248 |
| 4,110,173 | 8/1978 | Dix | 202/248 |
| 4,198,274 | 4/1980 | Ikio | 202/248 |

FOREIGN PATENT DOCUMENTS

| | | | |
|---|---|---|---|
| 906687 | 2/1954 | Fed. Rep. of Germany | 202/248 |
| 56675 | 10/1952 | France | 202/248 |
| 44415 | 4/1961 | Poland | 202/248 |
| 361929 | 11/1931 | United Kingdom | 110/173 R |

OTHER PUBLICATIONS

Lownie et al.; "Study of Concepts for Minimizing Emissions from Coke-Oven Door Seals"; EPA-650-/2-75-064; Jul. 1975.

*Primary Examiner*—Bradley Garris

*Attorney, Agent, or Firm*—Daniel J. Long; Herbert J. Zeh, Jr.

[57] ABSTRACT

A coke oven door seal in which a leaf spring is fixed to the inner end of a continuous concave seating structure which is peripherally mounted on the door frame. A terminally convex ridge structure extends endwise from the door jamb to flex the leaf spring sufficiently so as to form a continuous gas tight seal around the door. The leaf spring is flexed by the ridge by an amount that is greater than the deflection which would result only from the application of pressure on the leaf spring by coke oven gases. The leaf spring is also flexed by an amount that is less than the amount which would surpass its elastic limit. In an alternate embodiment, the leaf spring and seat structure are mounted on the door jamb while the ridge is mounted on the door frame.

12 Claims, 4 Drawing Figures

COKE OVEN DOOR SEAL

BACKGROUND OF THE INVENTION

1. Field of the Invention

The present invention deals with coke ovens and, in particular, with seals for coke oven doors.

2. Description of the Prior Art

In coke ovens, coal is conventionally coked in horizontal oven chambers which are interposed between flues containing hot gases. At opposite ends of these chambers there are doors which seal the oven chambers during the coking procedure and are removed to allow the coke to be pushed. Coke oven gases are generated inside the oven chamber and are evacuated to a collecting main. In order, however, to prevent oxygen from entering the chambers during the coking process, these gases are conventionally maintained at a pressure which is approximately 1 psi greater than atmospheric pressure so that if any leaks in the door occur outward emissions of coke oven gases rather than inward leaks of oxygen will result. While such an arrangement avoids combustion of the coke in the event of leaks, it does necessitate the use of a door seal which effectively seals the relatively large peripheral dimension of a coke oven door at high temperatures while the interior of the oven is maintained at a positive pressure relative to the atmosphere.

The prior art discloses numerous means for sealing coke oven doors. In many of these arrangements, a resilient metal sealing member on the door bears against a metal door frame. In certain devices, such as that shown in U.S. Pat. No. 4,016,045, spring driven plungers are positioned at spaced intervals along the periphery of the door to force the resilient sealing member against the door jamb. While such sealing means are effective when a door and jamb are originally installed, it is found that after sustained periods of use warping may occur so that the distance between the jamb and the door over the height of the door may become disuniform. In particular, it is found that the jamb may bow away from the door so that is tightly sealed at its top and bottom but spaced from the door near the center of its height. Although the use of intermittently spaced plungers may alleviate leakage resulting from such warping to some degree, the restraining force provided by the plungers may tend to be concentrated to the extent that leakage of coke oven gases may tend to occur medially between them. It is, therefore, the object of the present invention to provide a coke oven door seal that effectively compensates for any warping which may occur between the door and the door jamb.

SUMMARY OF THE INVENTION

The present invention is a coke oven door seal in which a continuous, concave and generally annulus shaped leaf spring seat is mounted along the periphery of the door. A continuous and generally annulus shaped leaf spring is fixed to the inner raised edge of this leaf spring seat and extends across the medial concave groove to rest on the outer raised edge of the seat. A continuous ridge is mounted on the door jamb so that it bears against the leaf spring on the door and flexes the leaf spring to a deflection which is greater than the deflection which would result solely from the pressure on the spring by the gases inside the oven chamber, but less than a deflection which would be beyond the elastic limit of the leaf spring.

BRIEF DESCRIPTION OF THE DRAWINGS

The present invention is further described in the accompanying drawings in which.

DETAILED DESCRIPTION

Figure 1:
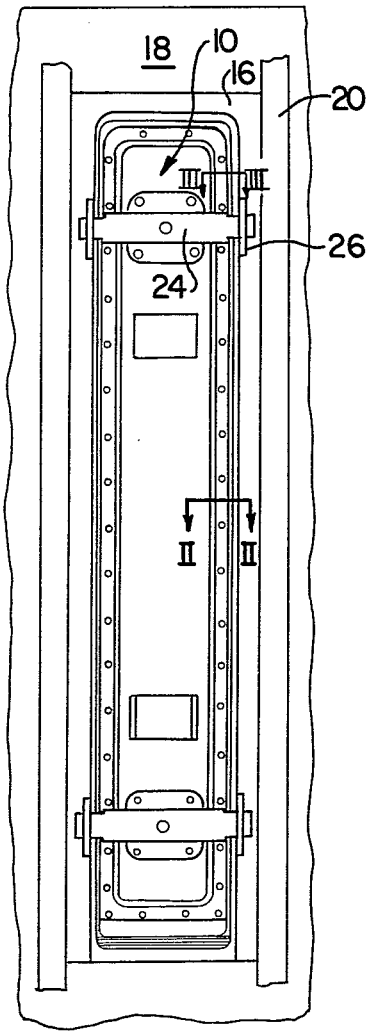
FIG. 1 is a front elevational view of a coke oven door in a closed position.
Figure 2:
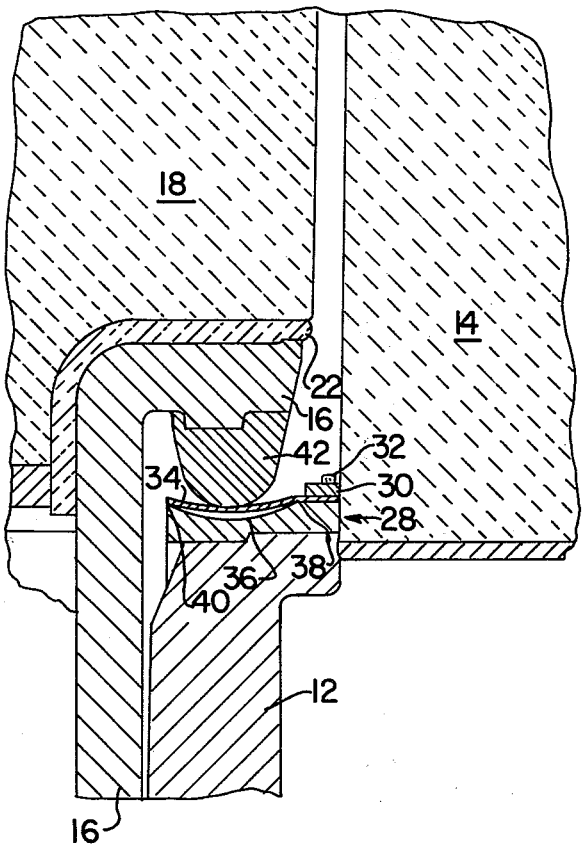
FIG. 2 is a cross-sectional view of a coke oven door seal taken along line II—II in FIG. 1.
Figure 3:
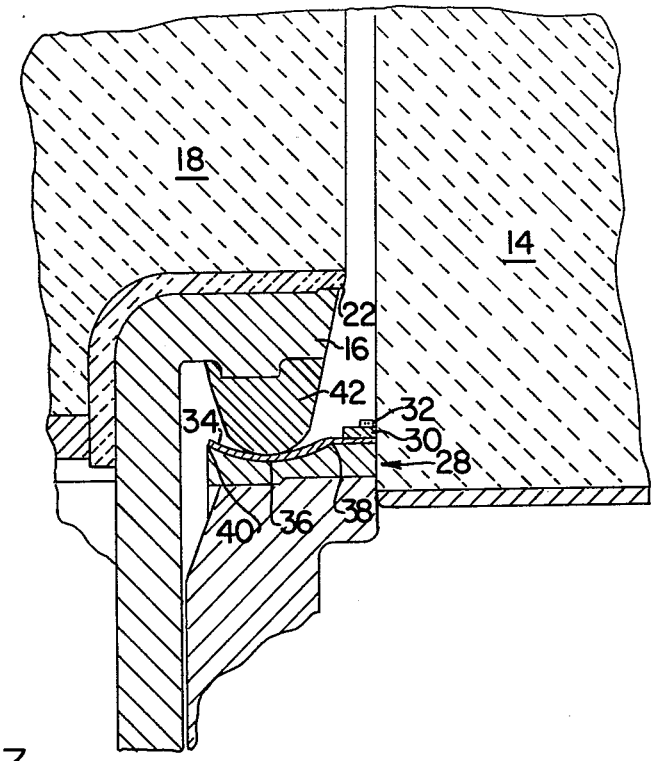
FIG. 3 is a cross-sectional view of a coke oven door seal taken along line III—III in FIG. 1.

Referring to FIGS. 1 through 3, a coke oven door is shown generally at numeral 10. The door includes a door frame 12 that supports a refractory plug 14. A door jamb 16 is mounted in the oven brickwork 18 and the oven brickwork is supported by buckstays as at 20. The space between the door jamb and the oven brickwork is sealed by means of an insulating packing strip 22. The door 10 is held in juxaposition with door jamb 16 by means of latches as at 24 which are engagable with hooks as at 26. It should be understood that the above described features are well known and conventional and do not in themselves describe the invention herein. Other equivalent arrangements to accomplish the above described functions are also possible.

FIGS. 2 and 3 show that a leaf spring seat structure shown generally at numeral 28 is mounted on the door frame. This seat structure is generally annulus shaped, that is, in this context, not necessarily and usually not circular but still continuous and ring shaped to conform to the periphery of the elongated door 10. For the purpose of orientation the terms "inward" and "inwardly" will herein be understood to refer to that direction which is radially inward toward the center of the door and the terms "outward" and "outwardly" will refer to that direction which is radially outward from the center of the door. Hence, on the inward side of the spring seat there is a spring retaining strip 30 connected to the seat structure by a plurality of bolts as at 32. It will be observed that a leaf spring 34 is retained between strip 30 and the seat structure 28. This leaf spring 34 is also continuous and generally annulus shaped and disposed adjacent the periphery of the door. It may be preferable to form leaf spring 34 from two or more separate leaf springs, one stacked on the other. It will be observed that the seat structure 28 is concave in shape so that it has a medial groove 36 interposed between an inner raised surface 38 and an outer raised surface 40. Extending endwise from the door jamb 16 is a continuous, peripheral ridge structure 42. When the door 10 is fixed to the door frame 12 by engaging the latches with the hooks as is shown in FIG. 1, the ridge 42 will continuously bear against the leaf spring 34 with sufficient force to flex the leaf spring. Where there has been a slight warping of the door jamb the ridge will generally flex the leaf spring by different amounts at different points along the periphery of the door. Near the top of the door, where the door jamb will typically be somewhat closer to the door frame than at the center of the door, the flexure will usually be greater than it will be at the center of the door. Hence, it will be seen that in FIG. 2 the deflection of the leaf spring 34 is less than it is in FIG. 3.

Figure 4:
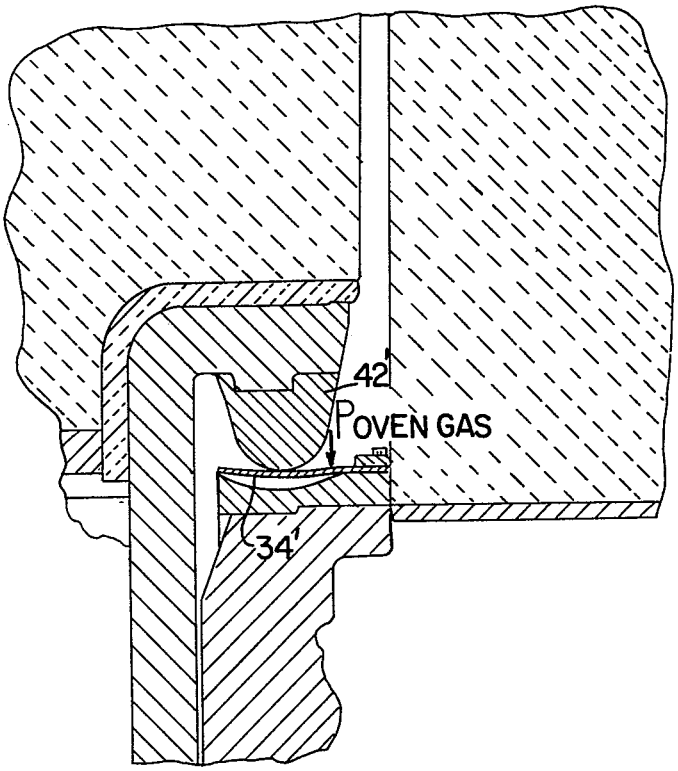
FIG. 4 is a cross-sectional view of a coke oven door seal of the present invention before sufficient force has been applied to the door to flex the leaf spring element of the seal to a degree sufficient to prevent the escape of coke oven gases.

Those skilled in the art will also recognize that there will be a minimum and a maximum deflection for the leaf spring 34. As to the minimum deflection, leaf spring 34 should be flexed sufficiently by the ridge 42 so that the pressure of the coke oven gas inside the coking chamber will not itself flex the leaf spring so that it is separated from the ridge so as to allow coke oven gas to leak outwardly into the atmosphere. Such a condition is shown in FIG. 4 in which the leaf spring 34' is about to be flexed by the pressure of oven gases (P oven gas) so that the leaf spring is then displaced from the ridge 42' and oven gases are allowed to escape into the atmosphere. On the other hand, where, as is shown in FIG. 2, the spring is already flexed by the ridge beyond the amount that would result from the oven gas pressure, then the minimum deflection is achieved and a condition as is illustrated in FIG. 4 would not result.

As to maximum deflection, it will be appreciated that the leaf spring should not be permanently deformed and, therefore, should not be flexed beyond its elastic limit. In order to prevent such excessive deflections of the spring, the maximum deflection which would be permissable for a particular spring length, thickness and material should be determined and the depth of the medial groove of the seat structure should be selected so that deflection beyond the elastic limit of the spring will not result. Such a condition of maximum deflection is shown in FIG. 3.

It will thus be appreciated that there has been described a coke oven door seal which will generally be gas tight even if irregularities develop between the door and the door jamb.

Although the invention has been described herein with a certain degree of particularity, it is to be understood that the present disclosure has been made only as an example and that the scope of the invention is defined by what is hereinafter claimed. In particular, it will be appreciated that it would be possible to mount the leaf spring and leaf spring seat combination described above on the door jamb in opposed relation to the ridge which could be mounted on the door frame. Such an arrangement is, therefore, considered to be within the scope of the present invention.

What is claimed is:

1. In a coke oven in which interposed between heating flues there is an elongated horizontal chamber for coking coal and generating coke oven gases, said gases being maintained in said chamber at greater than atmospheric pressure and said chamber having at its opposite ends first and second openings for pushing coke, which openings, respectively, are peripherally surrounded by first and second door jambs and are respectively closeable by first and second doors having peripheral door frames alignable and engageable in juxtaposed relation with said door jambs, wherein the improvement comprises:

(a) a continuous annulus shaped leaf spring seat structure peripherally mounted on the frame of said first door and having a continuous medial recessed surface interposed between raised inner and outer surfaces;

(b) a flexible continuous annulus shaped leaf spring superimposed over said leaf spring seat structure and fixed at its inner edge to said raised inner surface and moveably abutting said raised outer surface said leaf spring having a elastic limit which would not be reached as a result of deflecting said leaf spring toward the medial recessed surface of the leaf spring seat structure to such an extent that the leaf spring abuts said medial recessed surface; and (c) a continuous ridge structure projecting endwise from said first door jamb to medially flex said leaf spring by an amount which is less than that deflection which would result from exceeding the elastic limit of the leaf spring but which is more than the deflection which would allow gas pressure inside the oven to separate the leaf spring from the ridge structure and allow the escape of coke oven gases, such that a continuous, repeatedly reformable peripheral gas tight seal is formed around the first door.

2. The improved coke oven as recited in claim 1 wherein the medial recessed surface is concave.

3. The improved coke oven as recited in claim 1 wherein the leaf spring is interposed between the inner raised surface of the leaf spring seat structure and a continuous elongated retaining strip.

4. The improved coke oven as recited in claim 1 wherein the leaf spring consists of two or more separate leaf springs stacked one on the other.

5. The improved coke oven as recited in claim 1 wherein the ridge structure is terminally convex.

6. The improved coke oven as recited in claim 1 wherein there is:

(a) a second continuous annulus shaped leaf spring seat structure peripherally mounted on the frame of said second door and having a continuous medial recessed surface interposed between raised inner and outer surfaces;

(b) a second flexible continuous annulus shaped leaf spring superimposed over said second leaf spring seat structure and fixed at its inner edge to said raised inner surface and moveably abutting said raised outer surface; and (c) a second continuous ridge structure projecting endwise from said second door jamb to medially flex said leaf spring so as to form a continuous peripheral gas tight seal around the second door.

7. In a coke oven in which interposed between heating flues there is an elongated horizontal chamber for coking coal and generating coke oven gases, said gases being maintained in said chamber at greater than atmospheric pressure and said chamber having at its opposite ends first and second openings for pushing coke, which openings, respectively, are peripherally surrounded by first and second door jambs and are respectively closeable by first and second doors having peripheral door frames alignable and engageable in juxtaposed relation with said door jambs, wherein the improvement comprises:

(a) a continuous annulus shaped spring seat structure projecting endwise from said first door jamb and having continuous medial recessed surface interposed between raised inner and outer surfaces;

(b) a flexible continuous annulus shaped leaf spring superimposed over said leaf spring seat structure and fixed at its inner edge to said raised inner surface and moveably abutting said raised outer surface said leaf spring having an elastic limit which would not be reached as a result of deflecting said leaf spring toward the medial recessed surface of the leaf spring seat structure to such an extent that the leaf spring abuts said medial recessed surface; and (c) a continuous ridge structure peripherally mounted on the frame of said first door to medially flex said leaf spring by an amount which is less than that deflection which would result from exceeding the elastic limit of the leaf spring but which is more than that deflection which would allow gas pressure inside the oven to separate the leaf spring from the ridge structure and allow the escape of coke oven gases, such that a continuous, repeatedly reformable peripheral gas tight seal is formed around the first door.

8. The improved coke oven as recited in claim 7 wherein the medial recessed surface is concave.

9. The improved coke oven as recited in claim 7 wherein the leaf spring is interposed between the inner raised surface of the leaf spring seat structure and a continuous elongated retaining strip.

10. The improved coke oven as recited in claim 7 wherein the leaf spring consists of two or more separate leaf springs stacked one on the other.

11. The improved coke oven as recited in claim 7 wherein the ridge structure is terminally convex.

12. The improved coke oven as recited in claim 7 wherein there is:

(a) a second continuous annulus shaped spring seat structure projecting endwise from said second door jamb and having a continuous medial recessed surface interposed between raised inner and outer surfaces;

(b) a second flexible continuous annulus shaped leaf spring superimposed over said second leaf spring seat structure and fixed at its inner edge to said raised inner surface and moveably abutting said raised outer surface; and (c) a second continuous ridge structure peripherally mounted on the frame of said second door to medially flex said leaf spring so as to form a continuous peripheral gas tight seal around the second door.

* * * * *